US009417002B2

(12) United States Patent
Carlson et al.

(10) Patent No.: US 9,417,002 B2
(45) Date of Patent: Aug. 16, 2016

(54) ICE HANDLING CONTAINER

(75) Inventors: Brian Philip Carlson, Lakeville, MN (US); Ryan Allen Chernik, St. Paul, MN (US); Eric Richard Balz, Stillwater, MN (US); Christopher Carroll Wagner, St. Paul, MN (US)

(73) Assignee: Ecolab USA Inc, St. Paul, MN (US)

( * ) Notice: Subject to any disclaimer, the term of this patent is extended or adjusted under 35 U.S.C. 154(b) by 1122 days.

(21) Appl. No.: 13/458,201

(22) Filed: Apr. 27, 2012

(65) Prior Publication Data

US 2013/0284306 A1 Oct. 31, 2013

(51) Int. Cl.

| | |
|---|---|
| ***B65B 1/04*** | (2006.01) |
| ***F25C 5/00*** | (2006.01) |
| *B65D 25/32* | (2006.01) |
| *B65D 25/22* | (2006.01) |

(52) U.S. Cl.

CPC . *F25C 5/00* (2013.01); *B65D 25/22* (2013.01); *B65D 25/32* (2013.01); *Y10T 29/49826* (2015.01)

(58) Field of Classification Search

CPC ..... B65D 25/32; B65D 25/22; F25C 5/00; F25C 5/182

USPC ..... 141/366; 62/457.1; 294/137; 220/751, 220/755, 756, 760, 773; 248/211

See application file for complete search history.

(56) References Cited

U.S. PATENT DOCUMENTS

| | | | | |
|---|---|---|---|---|
| 1,492,453 | A * | 4/1924 | Haines | A01D 46/22 220/751 |
| 5,276,943 | A | 1/1994 | Ludy | |
| 5,402,910 | A * | 4/1995 | Pilney | B44D 3/12 220/570 |
| D611,307 | S | 3/2010 | Begin et al. | |
| 7,686,168 | B1 | 3/2010 | Smiley et al. | |
| 8,746,498 | B2 * | 6/2014 | Maldonado | A45F 5/02 220/756 |
| 2007/0235462 | A1 | 10/2007 | Omdoll et al. | |
| 2009/0032542 | A1 | 2/2009 | Temple | |
| 2009/0206569 | A1 | 8/2009 | Begin et al. | |
| 2009/0255942 | A1 | 10/2009 | Omdoll et al. | |
| 2009/0266738 | A1 | 10/2009 | Dunford et al. | |
| 2009/0294322 | A1 * | 12/2009 | Baltz | B65D 21/0233 206/519 |
| 2010/0187242 | A1 * | 7/2010 | Lynch | B65D 25/22 220/662 |
| 2013/0119069 | A1 * | 5/2013 | Groll | A47J 36/08 220/573.1 |

FOREIGN PATENT DOCUMENTS

JP 5-81035 U 11/1993

OTHER PUBLICATIONS

Ecolab USA Inc., PCT/US2013/038424, filed on Apr. 26, 2013 "The International Search Report and the Written Opinion of the International Searching Authority, or the Declaration", mail date Aug. 22, 2013.

* cited by examiner

*Primary Examiner* — Jason K Niesz

(74) *Attorney, Agent, or Firm* — McKee, Voorhees & Sease PLC

(57) ABSTRACT

The invention is an improved ice handling container and methods for using the container. The container includes a bottom wall with upstanding sidewalls terminating in a mouth. A bail having an apex and opposing ends is pivotally attached to opposing sidewalls of the container. The bail has a handle generally at the apex and a hook extending generally outwardly from the bail generally near the apex of the bail for hanging the container with the mouth facing generally upward. One sidewall has a handle generally adjacent the bottom wall and a hook generally adjacent the handle extending generally outwardly and upwardly from the sidewall for hanging the container with the mouth facing generally downward.

8 Claims, 9 Drawing Sheets

ICE HANDLING CONTAINER

BACKGROUND OF THE INVENTION

1. Field of the Invention

This invention relates generally to an ice handling container, and more particularly to an ice handling container and methods for filling, pouring from and drying the container.

2. Description of Prior Art

Handling ice using traditional and currently available containers, such as movement of ice from the point of production to a point of dispension and/or use (e.g., from the back of the house to the front of the house in restaurants) has limitations, including a high risk of the ice and/or container becoming contaminated.

Containers are also now configured to hold greater volumes of ice, but still suffer from ergonomical constraints that put unnecessary strain on the user and increase the risk of misuse of the container, which lends to contamination of the container and/or the ice. The growing size of these containers also often prohibits use and subsequent sanitization within a standard size dishmachine. The ever increasing size of these containers also increases the already burgeoning costs for shipping them from manufacturers and suppliers, and to purchasers.

The present invention addresses these problems and provides an improved ice handling container and methods for using the same.

In addition, the present invention addresses these problems by providing a container that promotes proper ice handling hygiene.

The present invention also addresses these problems by providing an ergonomical design with a large ice carrying volume while providing integrated features that allow more containers to be shipped without increasing the required shipping space and associated costs.

SUMMARY OF THE INVENTION

In one embodiment, the invention is an improved ice handling container. The container includes a bottom wall with upstanding sidewalls terminating in a mouth. A bail having an apex and opposing ends is pivotally attached to opposing sidewalls of the container. The bail has a handle generally at the apex and a hook extending generally outwardly from the bail generally near the apex of the bail for hanging the container with the mouth facing generally upward. In a preferred form, the handle includes opposing ends attached to the bail and hooks attached to the opposing ends of the handle. The hooks extend generally upwardly and outwardly from the opposing ends of the handle.

In another embodiment, the invention is an improved ice handling container that includes a bottom wall with upstanding sidewalls terminating in a mouth and a bail with opposing ends pivotally attached to opposing sidewalls. One sidewall has a handle generally adjacent the bottom wall and a hook generally adjacent the handle extending generally outwardly and upwardly from the sidewall for hanging the container with the mouth facing generally downward. In a preferred form, the container includes a recess in the sidewall adjacent the bottom wall. A handle assembly with the handle and the hook is removably nested in the recess. The attached handle assembly prevents nesting of two or more containers together.

In another embodiment, the invention is a method for filling an ice handling by gripping a handle generally at an apex of a bail with opposing ends pivotally attached to opposing sidewalls adjacent a mouth of an ice handling container and hanging the container on a generally upstanding surface adjacent an ice source by a hook extending generally outwardly from the handle near the apex of the bail. In a preferred form, the handle is rotated toward the generally upstanding surface for hanging the container and rotated away from the generally upstanding surface for lifting the container. The mouth of the container is kept generally horizontal by supporting a bottom portion of a sidewall with a sidewall handle resting against the generally upstanding surface of the ice source.

In another embodiment, the invention is a method for drying an ice handling container by taking an ice handling container having a bottom wall with upstanding sidewalls terminating in a mouth, a handle assembly with a generally horizontal handle on a sidewall adjacent the bottom wall of the container, and a hook separate from the handle extending generally outwardly and upwardly from a handle assembly, and hanging the container upside down by the hook. In a preferred form, the handle assembly is removably attached within a recess in the sidewall adjacent the bottom wall of the container and to prevent two or more of the containers from being nested together after use.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings, in which:

DETAILED DESCRIPTION OF THE PREFERRED EMBODIMENTS

Referring to the figures, there is generally disclosed in FIGS. 1-9 an improved ice handling container for handling and transporting ice in a sanitary manner. Also disclosed are methods for using the improved ice handling container according to exemplary aspects of the present invention.

Figure 1:
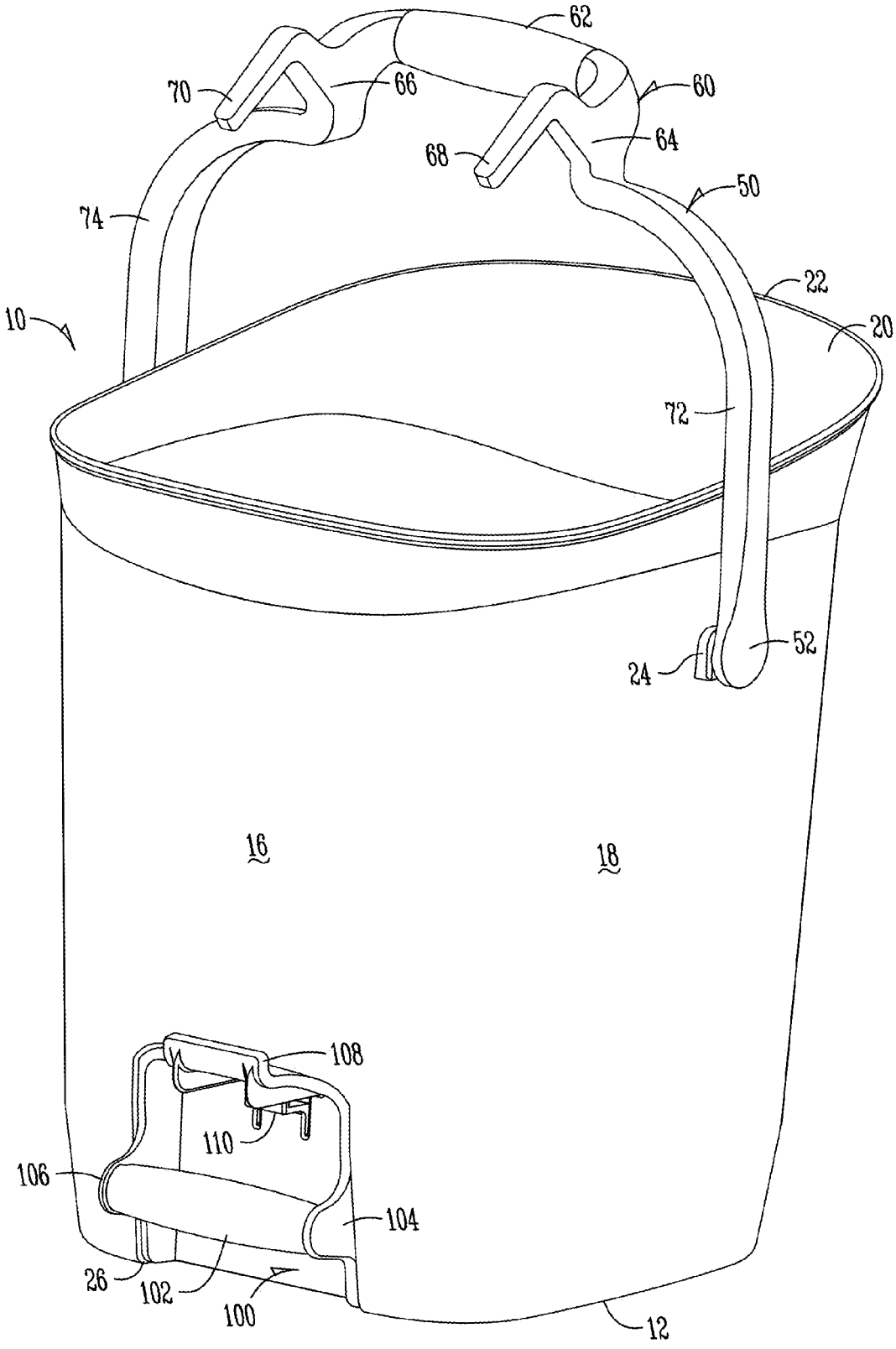
FIG. 1 is a perspective view of the container according to an exemplary embodiment of the present invention.
Figure 2:
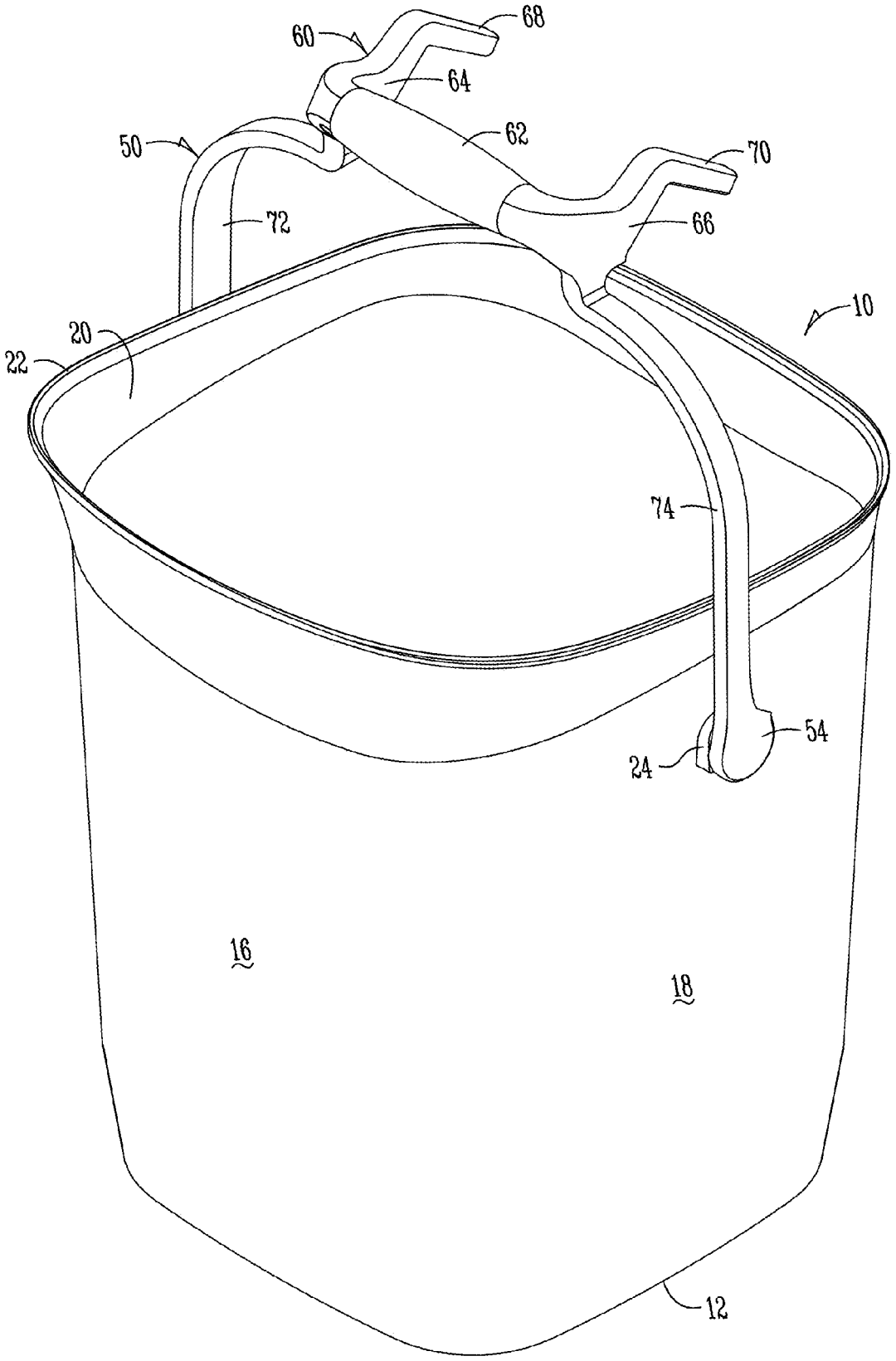
FIG. 2 is another perspective view of the container illustrated in FIG. 1.
Figure 3:
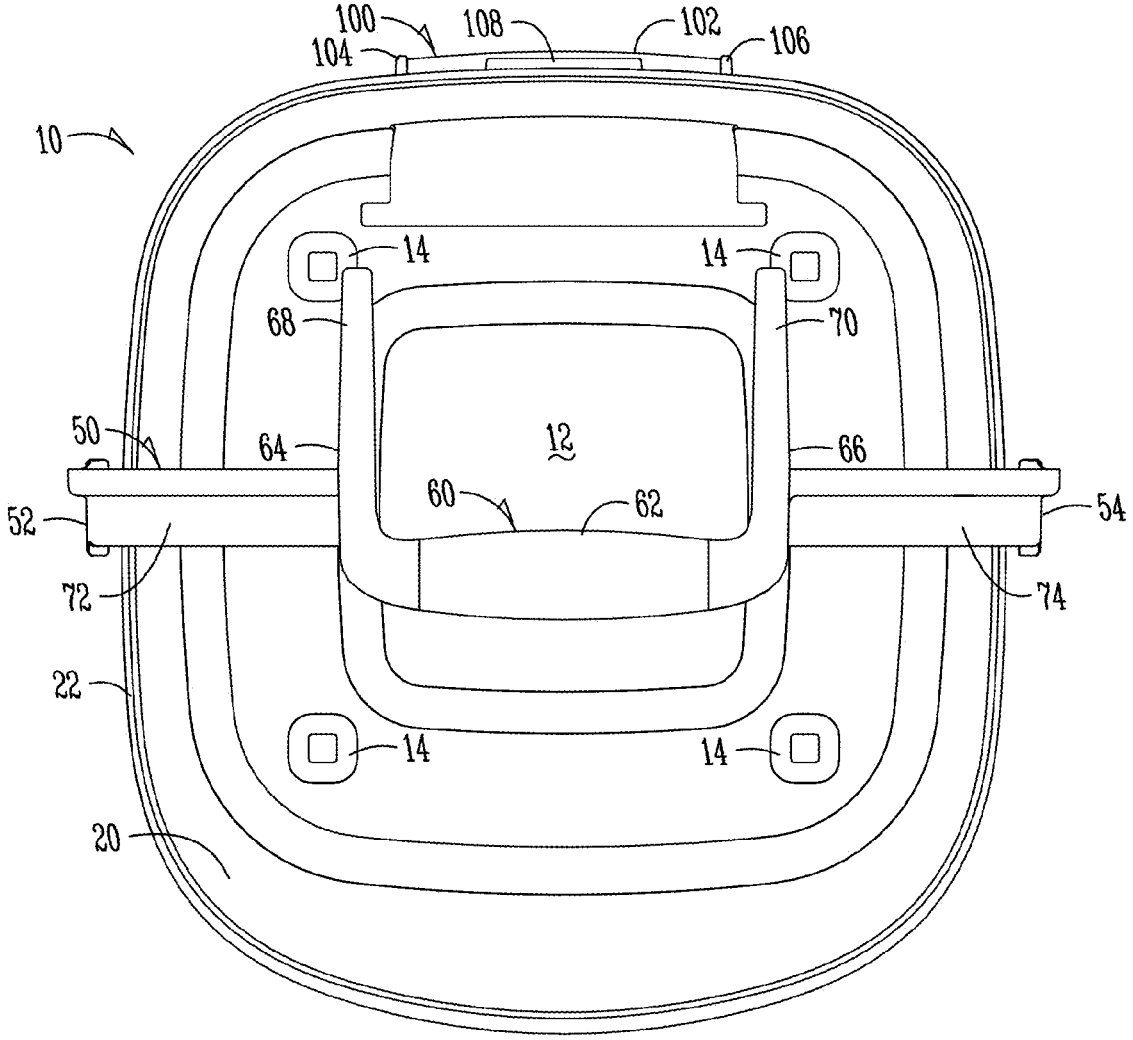
FIG. 3 is a top plan view of the container illustrated in FIG. 1.

FIG. 1 is a perspective view of an ice handling container 10 according to an exemplary aspect of the present invention. The container 10 includes a base 12 with feet 14 best shown in FIG. 4 positioned nearly diametrically about the base 12 for supporting the base of the container 10. A pair of opposing sidewalls 16 and 18 forming an upstanding boundary about the base 12 extend generally vertically upward terminating in the mouth of the container 20. In one aspect of the invention, the sidewalls 16 and 18 include sections having varying tapers relative to a vertical plane. For example, in one aspect, a lower portion of the container 10 includes a greater taper relative to vertical than the upper portion of the container 10, and the mouth of the container 20 is configured to have a taper relative to vertical greater than the upper and lower portions. As shown in the figures, the mouth 20 of the container 10 includes lip 22 extending generally upwardly and outwardly to flare the mouth 20 of the container 10 to aid in minimizing the amount of ice spilled when filling the container 10 and direct the ice out of the bucket in a collective stream to prevent the ice from spilling when pouring it from the container 10. In one exemplary aspect of the invention, the lip 22 of the container 10 is tapered outwardly at an angle between 20° and 35° relative to a vertical plane to achieve the aforementioned objectives. The container 10 is preferably constructed from materials such a polypropylene or other material suitable for withstanding impact in abrasion and compatible with dishmachine chemistries. In one aspect of the invention, the wall thickness of the container 10 is approximately 0.09 inches for increasing the strength in long term ability of the container to withstand impacts and abrasion. The container 10 is generally square shaped but may be rectangular or circular in shape. In a preferred aspect of the invention, the container 10 exhibits a square-shaped profile thereby keeping the overall height of the container 10 less than an equivalent capacity container that has a round profile. The volume of the container 10 is configured to hold roughly 25 pounds of ice or 6 gallons of ice according to an exemplary aspect of the invention. The height of the container 10 is preferably less than or equal to the height required to fit within a standard commercial dishmachine. For example, the height of the container 10 may be less than 18 inches to fit inside a commercial dishmachine having an 18-inch height opening according to one exemplary aspect of the invention.

Opposing sidewalls 18 of the container 10 include ears 24 positioned generally at the middle of the sidewall and approximate the mouth 20 of the container 10. In one aspect of the invention, the ears 24 are positioned closer to the center of gravity of the container 10 to lessen the strain on the user when pouring ice from the container 10. Furthermore, the ears 24 may be positioned off-center on the opposing sidewalls 18 to further aid in the ease of pouring ice from the container 10. Each ear 24 is configured to receive posts 56 and 58 on respective ends 52 and 54 of the bail 50 best illustrated in FIG. 8. The posts 56 and 58 may be removably attached to the ears 24 on the container. In a preferred form, the posts 56 and 58 are pivotally attached to ears 24 on the container 10 which allows the bale 50 to pivot about the ears. Specifically, the bale 50 is permitted to rotate from an upstanding position to adjacent either sidewall 16 and any point between.

The bale 50 is generally semicircular in shape and includes opposing legs 72 and 74 extending from the apex of the bale 50 and terminating in opposing ends 52 and 54 having the posts 56 and 58 discussed above. The bale 50 includes generally at its apex a handle assembly 60. The handle assembly 60 includes respective ends 64 and 66 attached to the bale 50 generally at the apex of the bale 50 with a handle 62 spaced between the ends 64 and 66. A hook 68 and 70 extend upwardly and outwardly from respective ends 64 and 66 of the handle assembly 60. In one embodiment, the hooks 68 and 70 have a first portion extending generally upwardly and outwardly from respective ends 64 and 66 of the handle assembly 60 and a second portion extending generally outwardly and downwardly from the first portion to form a hook for gripping the top edge of an upstanding wall associated with or near a point of ice production and/or dispension. The present invention also contemplates that the first and/or second portion of respective hooks 68 and 70 may be connected together by a continuous or partial webbing. Alternatively, the outer portions of respective hooks 68 and 70 may be connected by a section, such as a solid webbing extending there between leaving an open section between the first portions of respective hooks 68 and 70 adjacent the handle 62, such as to allow a user to insert his or her hand into the handle assembly 60 for gripping the handle 62 of the handle assembly 60.

According to one exemplary aspect of the invention, the handle 62 of the handle assembly 60 includes respective ends 64 and 66 secured to the bail 50 as discussed above. The ends 64 and 66 may be configured so that the handle 62 is positioned generally upwardly and outwardly from the bail 50 and in a direction opposite the direction of respective hooks 68 and 70. Alternatively, the handle 62 may be configured to extend upwardly in a generally vertical plane relative to the bail 50 or extend horizontally outward from the bale 50. The handle 62 may also be part of the bail 50, and the hooks 68 and 70 may be configured to extend upwardly and outwardly from the bail 50 as well. The bail 50 may include one or more strengthening ribs for providing structural rigidity to the legs 72 and 74 of the bail 50.

Figure 4:
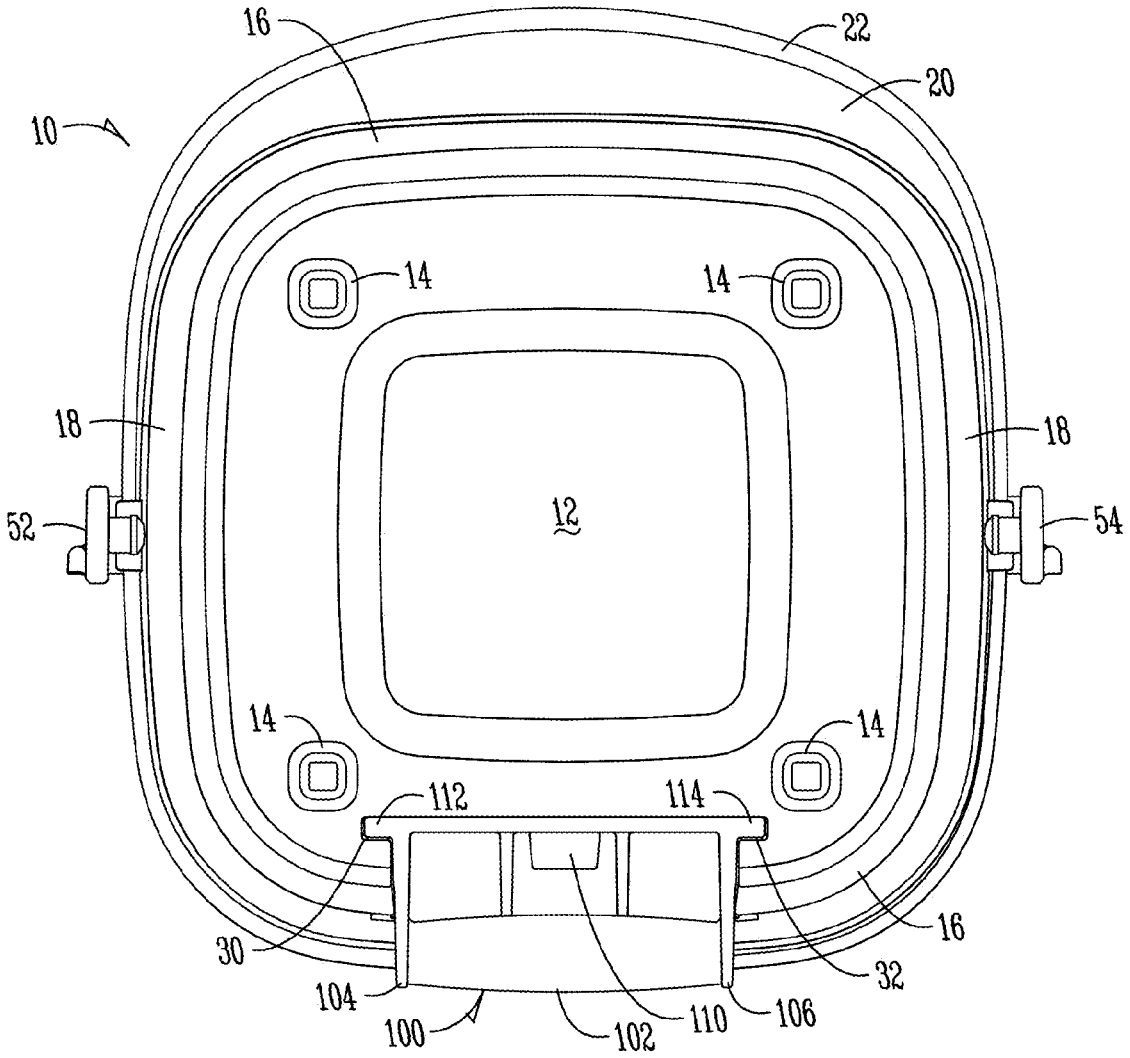
FIG. 4 is a bottom plan view of the container illustrated in FIG. 1.
Figure 5:
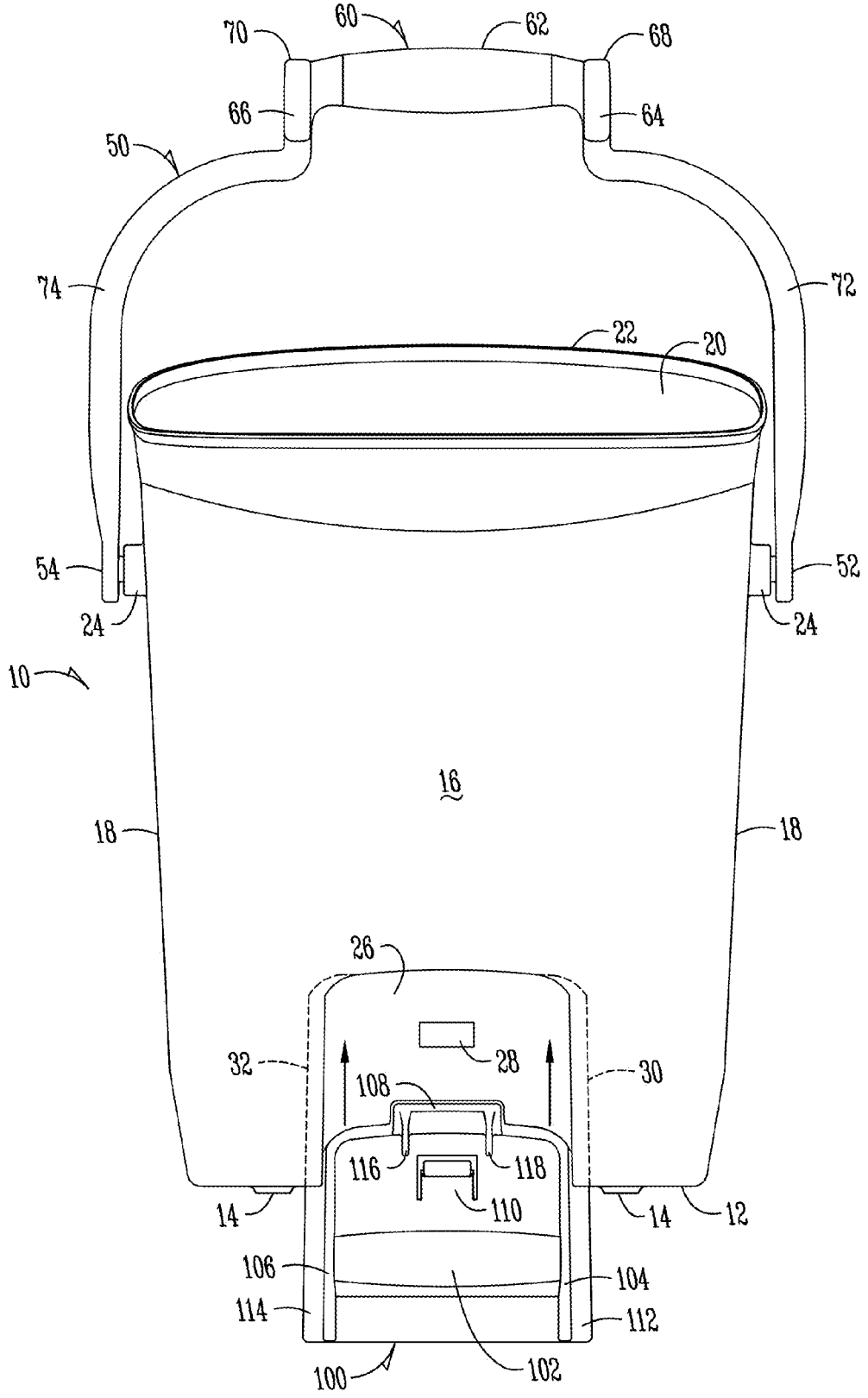
FIG. 5 is a perspective view of the container illustrating a handle assembly according to an exemplary embodiment of the present invention.
Figure 6:
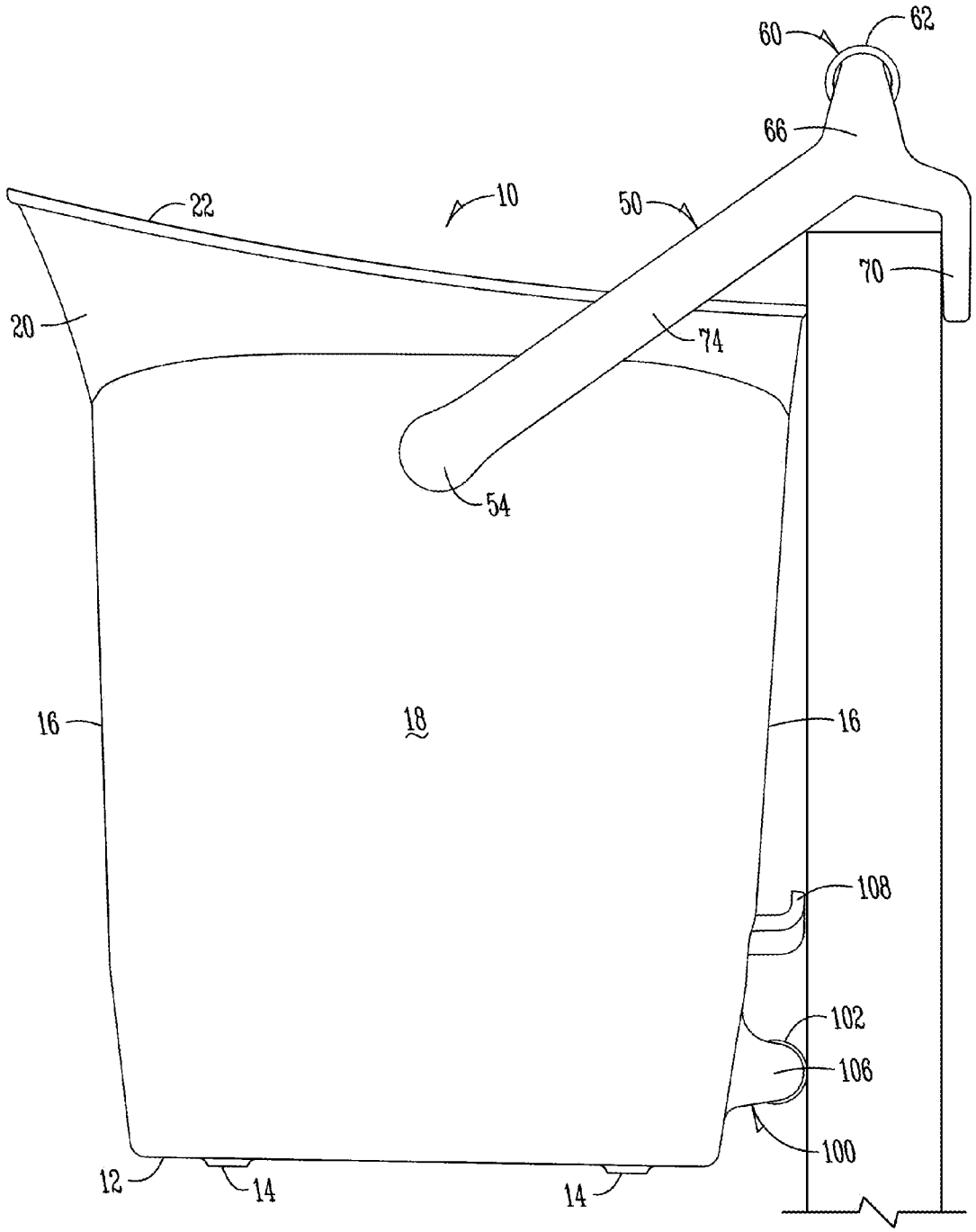
FIG. 6 illustrates the container shown in FIG. 1 hung at a point of ice production and/or dispension.
Figure 9:
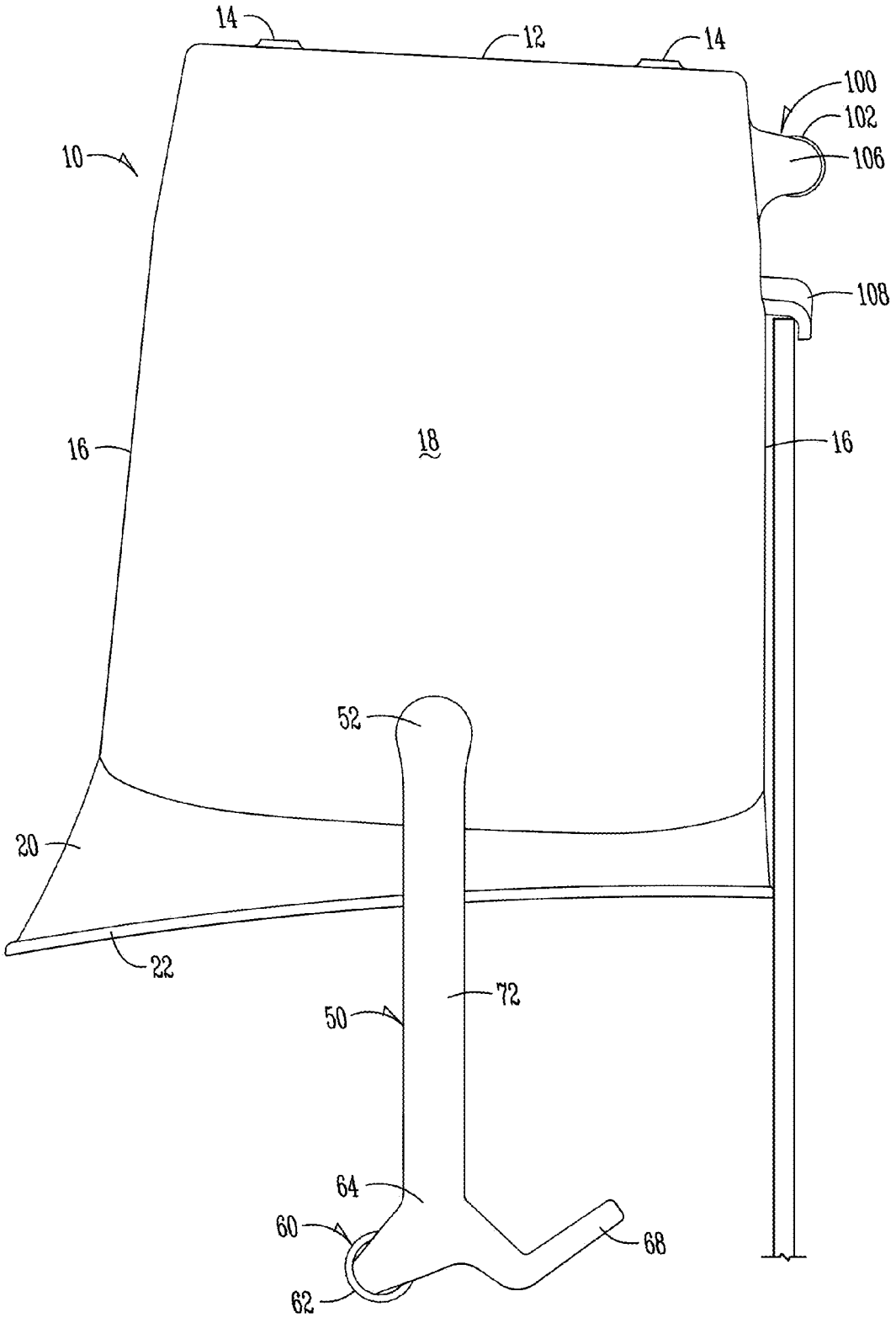
FIG. 9 illustrates the container shown in FIG. 1 hung upside down.

As best illustrated in FIGS. 4-5, one sidewall 16 of the container 10 includes a recess 26 near the base 12 that extends upward from the base 12 through a portion of the sidewall 16 toward the mouth 20 of the container 10. The recess 26 includes grooves 30 and 32 in the outer generally vertically extending walls. The recess 26 also includes a detent 28 in the back wall spaced between the grooves 30 and 32. In one aspect of the invention, a handle assembly 100 is removably received within the recess 26 of the container 10. The handle assembly 100 includes ribs 112 and 114 received within respective grooves 30 and 32 of the recess 26. To assemble the handle assembly 100 to the container 10, the handle assembly 100 is slid into the recess 26 with ribs 112 and 114 in respective grooves 30 and 32 of the recess 26 until the tab 110 flexibly supported by a flange on the handle assembly 100 is removably received within the detent 28 of the recess 26. The tab 110 may include a flange extending inwardly generally horizontally from the tab 110 which is received within the detent 28. In the installed position, the outer framework of the handle assembly 100 mates with the upstanding, back wall and top wall of the recess 26. The handle assembly 100 may be removed from the recess 26 by pulling the tab 110 out of interference with the detent 28 in the recess 26 to remove the interference and allow the handle assembly 100 to separate from the container 10. The handle assembly 100 also includes a hook 108 extending generally outwardly and upwardly from an upper portion of the framework of the handle assembly 100. In the installed position, the hook 108 extends outwardly and upwardly from the sidewall 16 of the container 10 as best illustrated in FIG. 6. The hook 108 may include one or more strengthening ribs to provide structural rigidity to the hook 108 such as ribs 116 and 118 illustrated in FIG. 5. The hook 108 includes a generally horizontally extending portion terminating a generally vertically extending portion. When installed in the recess 26 of the container 10, the horizontally extending portion extends generally outwardly from the sidewall 16 and the vertically extending portion extends generally vertically and parallel with the sidewall 16. The gap formed between the sidewall 16 and the generally vertically extending portion of the hook 108 allows the top edge of an upstanding wall such as at a point of ice production or dispension to be received within the hook to allow the container 100 to be hung upside down for drying, storage and preventing accumulation of contaminants, such as illustrated in FIG. 9. The handle assembly 100 also includes a handle 102 with opposing ends 104 and 106 attached to the framework of the handle assembly 100. The handle 102 is based away from the inner wall of the framework of the handle assembly 100 to allow a user to place his or her hand into and around the handle 102 of the handle assembly 100.

Illustrative figures of the present invention provide exemplary uses for the container 10 shown in the figures. According to one exemplary use of the container 10, the bail 50 is used for hanging the container 10 from the top edge of an upstanding wall at an ice machine and/or a point of ice dispension as best illustrated in FIG. 6. To hang the container 10 over the edge of the upstanding wall, gripping the handle 62 of the bale 50, the user moves the container 10 generally toward the top edge of the upstanding wall. The lip 22 on the sidewall 16 carrying the handle assembly 100 engages the upstanding wall and/or edge at which point the bale 50 is rotated until the hooks 68 and 70 grip the top edge of the wall as shown. Alternatively, the container 10 may be hung from the upstanding wall or edge of the wall by gripping the bottom of the container 10 with one hand while gripping the handle 62 on the bail 50. The weight of the container 10 is supported with the one hand while the other hand moves the bail so that the hook 68 and 70 are in position over the top edge of the upstanding wall. The length of the hooks 68 and 70 (particularly the first portion of the hooks adjacent the handle), aids in drawing the lip 22 of the container 10 adjacent the top edge of the upstanding wall when hung. The second portion of the hooks 68, 70 wraps around the inner edge (adjacent the top wall) of the upstanding wall to create an interference and prevent the hooks 68, 70 from separating from the edge of the upstanding wall when hung. The present invention contemplates that the length of the first and second portions of respective hooks 68 and 70 may be adjusted to accommodate varying edge widths for the upstanding wall from which the container 10 is hung. As best illustrated in FIG. 6, when the container 10 is hung from the upstanding wall, the handle 62 of the handle assembly 60 on the bale 50 is spaced a sufficient distance away from the edge of the upstanding wall forming a gap to allow a user to place his or her hand around the handle 62 for gripping it and manipulating the bail 50 of the container 10. In one aspect of the invention, as addressed above, the handle 62 is spaced outwardly and in the opposite direction of the hooks 68 and 70 by ends 64 and 66 of the handle assembly 60 to create a gap between handle 62 and the top edge of the upstanding wall. Thus, even when the container 10 is hung by the bail 50 at the edge of an upstanding wall, a sufficient gap resides between the handle 62 and the edge of the upstanding wall to allow the user to easily grip and manipulate the bail. This is particularly important when the container 10 is full of ice and may weigh upwards of 25 pounds. The configuration of the handle assembly 60 on the bale 50 allows the user to insert his or her hand in the gap between the handle 62 and the upstanding edge without having to manipulate the container or work against the weight of the container 10 while trying to grip the handle 62. The aforementioned features also minimize the potential for handling of the container mouth when hanging, filling and separating the container from the upstanding edge from which it's hung.

As addressed above, a handle assembly 100 is removably attached to sidewall 16 of the container 10, which faces the upstanding wall when the container is hung by the bail 50. The handle 102 extends outwardly from the sidewall 16 and terminates in a vertical plane generally collinear with the lip 22 of the mouth 20 of the container 10. The handle 102 of the handle assembly 100 rests against the upstanding wall keeping the mouth 20 of the container 10 in a generally horizontal plane at the edge of the upstanding wall from which the container 10 is hung. The mouth 20 of the container 10 includes a lip portion 22 that is flared outwardly to assist in capturing ice and preventing it from spilling while filling the container 10 with ice. Keeping the mouth 20 of the container 10 in a generally horizontal plane also inhibits ice from spilling from the container when filled.

Once the container 10 is filled with ice to a desired level, the container 10 is lifted from the edge of the upstanding wall by gripping the handle 62 and lifting upward to remove the hooks 68 and 70 from interference with the top edge of the upstanding wall. According to a preferred aspect of the invention, the bail 50 is separated from the upstanding wall by gripping the handle 62 and rotating the handle to a generally vertical position. By rotating the bail 50 to a generally vertical position, the hooks 68 and 70 are removed from interference with the top edge of the upstanding wall and the container 10 is free to be separated from the wall for porting to another location. Advantageously, rotating the bail 50 from the hung position to the upright position does not require changing the position of the mouth 22 of the container 10 relative to a horizontal plane thereby inhibiting spillage of ice from the container 10 when separating the container 10 from the upstanding wall. Additionally, the configuration of the handle assembly 60 on the bail 50 allows the user to grip the handle 62 and manipulate the bail 50 without touching the lip 22 or mouth 20 of the container 10 to prevent exposing the container 10 to contaminants or possible contamination.

As previously discussed, the bail 50 is preferably pivotally attached to the container 10 by posts 56 and 58 received within ears 24 on opposing sidewalls 18. The ears 24 are positioned on the container 10 relative to the center of gravity of the container 10 and relative to the mouth 20 of the container 10 to avoid being top heavy and creating undesirable swinging of the container 10 when porting it to and from various locations. However, the bail 50 is preferably pivotally attached to the container 10 closer to the center of gravity of the container 10 to making it easier on the user for pouring ice from the container 10. According to an exemplary aspect of the invention, ice is poured from the container 10 by gripping the handle 62 with one hand and the handle 102 with the other handle while drawing or lifting the handle 102 upward toward the handle 62 on the bail 50. Since the pivot point of the bail 50 on the container 10 is closer to the center of gravity, the container 10 easily pivots to allow the ice to be poured out the mouth over the lip 22 of the container 10. Both handles 62 and 102 are preferably collinear with generally horizontal planes which facilitate a very natural grip for both hands of the user. Gripping the handles 62 and 102 the user is able to tilt the container 10 without having to contort their body, arms or hands in an uncomfortable manner. This is accomplished as both handles 62 and 102 reside in generally parallel planes throughout the whole pouring motion. The lip 22 at the mouth 20 of the container 10 is flared outwardly which helps direct the ice in a fluid, collective stream out of the container 10 thereby minimizing spillage.

Figure 7:
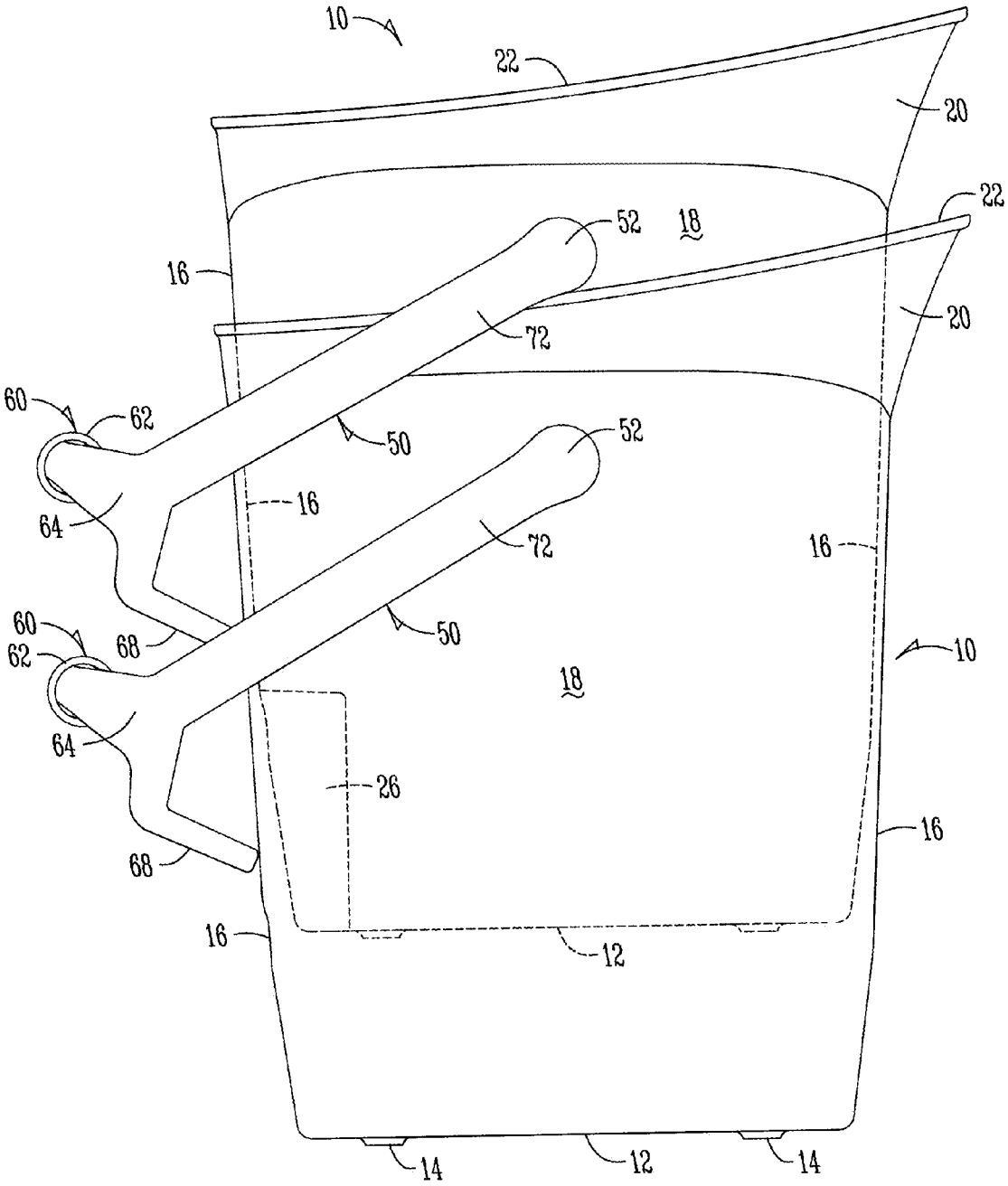
FIG. 7 illustrates two of the containers illustrated in FIG. 1 nested together.
Figure 8:
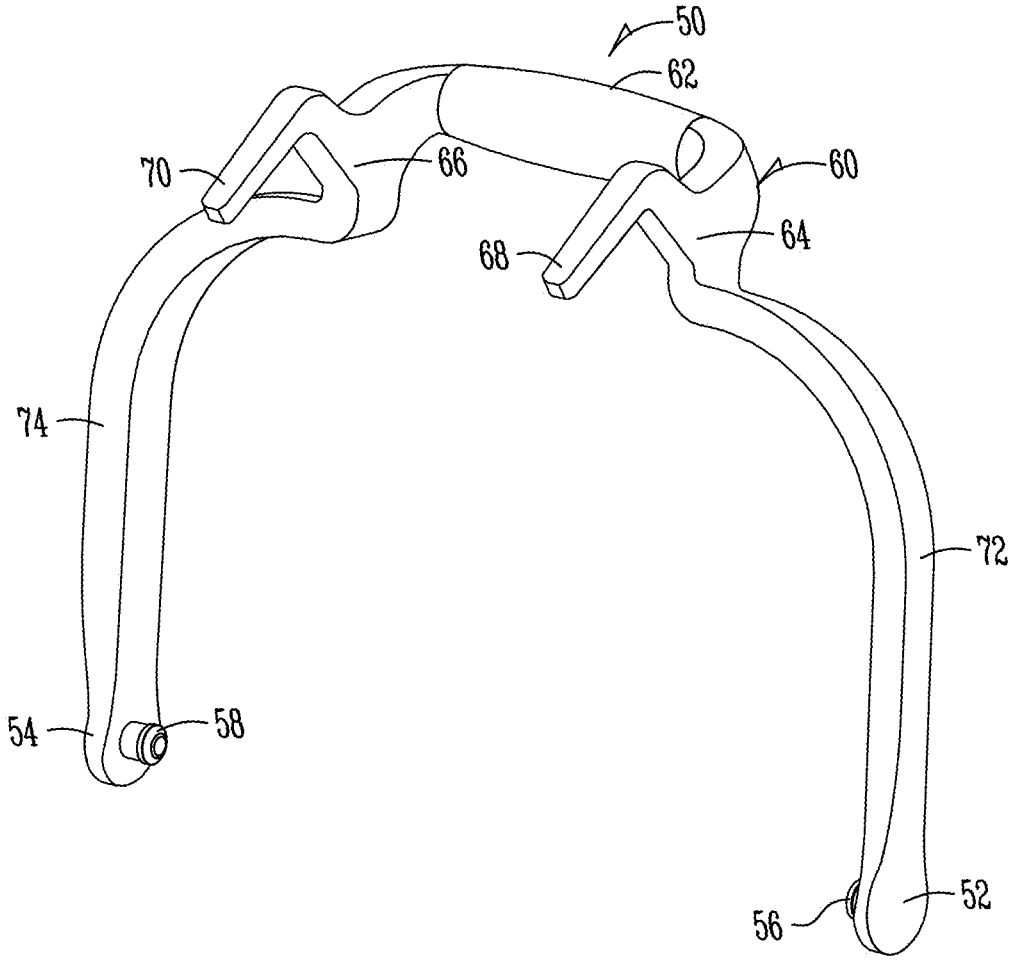
FIG. 8 is a perspective view of the bail illustrated in FIG. 1.

FIG. 7 illustrates another exemplary aspect of the present invention in which containers 10 are shown nested together. Specifically, a portion below the ears 24 of one container is nested within the container 10 beneath it. In this configuration, as much as 70% of the top container 10 nests within the bottom container 10. The containers are configured to nest together prior to attachment of the handle assembly 100 to consolidate the containers during shipping and handling. When the container 10 is received and prepared for use, the handle assembly 100 is snapped into place in the recess 26 in the container 10 which prevents the container 10 from being renested into another container as the perimeter of the container with the handle assembly 100 attached exceeds the perimeter of the mouth 20, and thereby prevents these containers from being nested one inside another during use. As will be appreciated by those skilled in the art, the outside of container 10 is often handled extensively and accumulates contaminants over time and other materials not suitable for human consumption, that when the container 10 is nested within another would contaminate the inside of the receiving container and the ice subsequently carried in the container 10. Thus, the removability of the handle assembly 100 allows the containers to be shipped in a consolidated manner, removed and assembled for use to prevent subsequent nesting of the containers. The replacability of both the bail 50 and handle assembly 100 allows both components to be replaced on a container 10 without having to replace the entire container 10 if they were to become damaged or broken during use. These also may be removed or separated from the container 10 when running the container 10 through a commercial dish machine to allow the entirety of the interior and exterior surfaces of the container 10 to be fully sanitized and ready for reuse. These components may also be washed and sanitized separately to make sure that the entirety of the container and its components are kept sanitized for subsequent usage.

When the container 10 is finished being used or in between uses, the container 10 can be hung upside down by the handle assembly 100 as shown in FIG. 9. The hook 108 extends generally outwardly from the sidewall 16 of the container and terminates in a generally vertically extending portion. The container 10 is hung upside down by placing the gap between the sidewall 16 and the vertical portion of the hook 108 over an edge of an upstanding wall or another suitable structure. By hanging the container 10 upside down, contaminants and other materials that might otherwise collect in the container 10 if it were stored upright are not permitted to enter or settle within the container 10. Also, the hook 108 and lip 22 of the container 10 are generally collinear with a vertical plane, which keeps the container generally vertical when hung by the hook 108. As discussed above, the handle 102 on the handle assembly 100 and the hook 108 are generally collinear with a vertical plane so the handle 102 helps protect the hook 108 from being damaged or broken during use. When the container 10 is inverted, the handle 102 is above the hook 108 which allows the container 10 to be manipulated and handled without having to touch surfaces (e.g., interior surfaces) that are generally in contact with the ice.

The above specification, examples, and information provide a description of the manufacture and use of the compositions of the invention. Since many embodiments of the invention can be made without departing from the spirit and scope of the invention, the invention resides in the claims hereinafter appended.

What is claimed is:

1. An ice handling container comprising:

a. a bottom wall with upstanding sidewalls terminating in a mouth having a lip, wherein a portion of the mouth flares outwardly relative to vertical greater than a taper associated with the upstanding sidewalls to aid the flow of material out of the container;

b. a bail having an apex and opposing ends pivotally attached to opposing sidewalls;

c. the bail having a handle proximate to the apex; and d. at least one hook extending outwardly from the bail proximate to the apex of the bail for hanging the container with the mouth facing substantially upward.

2. The container of claim 1 wherein the taper of the upstanding sidewalls allows for nesting of two or more ice handling containers.

3. The container of claim 1 wherein a width of the portion the mouth is associated with one of the upstanding sidewalls and is of greater width than a width of a portion of the mouth associated with each of remaining upstanding sidewalls.

4. The container of claim 1 further comprising one or more feet extending from an outer surface of the bottom wall, said one or more feet positioned diametrically about the outer surface of the bottom wall and configured to support the bottom wall of the container.

5. An ice handling container comprising:

a. a bottom wall with a pair of opposing upstanding sidewalls terminating in a mouth having a lip, wherein a portion of the mouth has a taper relative to vertical greater than a taper associated with the pair of opposing upstanding sidewalls;

b. a bail having an apex and opposing ends pivotally attached to one pair of the opposing sidewalls;

c. a handle at the apex of the bail, the handle includes:

i. opposing ends connected to the bail; and ii. at least one hook attached proximate to the opposing ends of the handle, said at least one hook extending outwardly away from the handle for hanging the container with the mouth facing substantially upward; and wherein the bail, the handle, and the at least one hook are integrally formed and the at least one hook is positioned within an area extending upwardly and defined by the mouth.

6. The container of claim 5 wherein the mouth is flared to aid the flow of material out of the container.

7. The container of claim 5 wherein a width of the portion the mouth that is associated with one of the upstanding sidewalls is greater than a width of a portion of the mouth associated with each of remaining upstanding sidewalls.

8. The container of claim 5 further comprising one or more feet extending from an outer surface of the bottom wall.

* * * * *